United States Patent [19]

Mehlan et al.

[11] 4,396,106

[45] Aug. 2, 1983

[54] MECHANICAL VENDING MACHINE HAVING SLIDABLE PIVOTAL COIN ANALYZER

[75] Inventors: Bernd Mehlan; Manfred Heim; Rudolf Leichs, all of Herrieden, Fed. Rep. of Germany

[73] Assignee: Sielaff GmbH & Co., Fed. Rep. of Germany

[21] Appl. No.: 307,293

[22] Filed: Sep. 30, 1981

[30] Foreign Application Priority Data

Nov. 11, 1980 [DE] Fed. Rep. of Germany ..... 3042408
Nov. 11, 1980 [DE] Fed. Rep. of Germany ..... 3042409

[51] Int. Cl.[3] ..... G07F 11/48
[52] U.S. Cl. ..... 194/97 R; 194/1 A
[58] Field of Search ..... 194/97 R, 1 A, 1 B, 194/1 G, 1 L, DIG. 2, DIG. 3, 102

[56] References Cited

U.S. PATENT DOCUMENTS 3,163,278 12/1964 Rounsivell ..... 194/97 R
4,368,804 1/1983 Cole ..... 186/57

*Primary Examiner*—Stanley H. Tollberg

*Attorney, Agent, or Firm*—McGlew and Tuttle

[57] ABSTRACT

A mechanical vending machine with a coin analyzer and a control mechanism for the release of merchandise dispensing devices after the insertion of an appropriate amount in coins, has the control mechanism being coupled to a locking bar of the merchandise dispensing devices and has a slide lock for the locking bar. To make the control mechanism accessible and to disengage it, the coin analyzer and the control mechanism are disposed on a bracket mounted on horizontal tracks of the vending machine so as to be movable from a pushed-in position to a pulled-out position. The bracket has a hinge by means of which it can be pivoted in the pulled-out position about a vertical axis. Disposed on the bracket is a coupling device which couples the control mechanism to the locking bar and to the slide lock in the pushed-in position, and which disengages when moved into the pulled-out position. In order to make coin stores of a coin return mechanism, which are behind the coin analyzer, readily accessible, the coin stores are fastened to a bracket which can be pulled out along the track, parallel to the merchandise dispensing compartment.

10 Claims, 11 Drawing Figures

MECHANICAL VENDING MACHINE HAVING SLIDABLE PIVOTAL COIN ANALYZER

FIELD AND BACKGROUND OF THE INVENTION

The invention relates in general to vending machines, and in particular to a new and useful mechanical vending machine with a coin analyzer and a control mechanism for the release of a merchandise dispensing device after the insertion of an appropriate amount in coins, the control mechanism being coupled to a locking bar of the merchandise dispensing devices and having a slide lock for the locking bar.

For additional information please refer to the copending applications entitled, PRICE SETTING MECHANISM FOR A VENDING MACHINE and TRAP DOOR CHUTE FOR VENDING MACHINES, which are incorporated here by reference.

Such a vending machine is described in German Gebrauchsmuster No. 79 09 711, for instance. In that document the coin analyzer is formed by a coin checker, a crediting unit and a coin collector. The control mechanism is a multiple price control.

A vending machine of this type is also described in German Auslegeschrift No. 26 44 858.

In these vending machines, the coin analyzer and the control mechanism are permanently installed in the vending machine. This has the disadvantage that it is difficult to get to the mechanism if it must be serviced in case of trouble. This applies in particular when the coin analyzer and the control mechanism are very close to the sidewall of the vending machine. This is desirable so that as much space as possible can be utilized for the accommodation of merchandise.

For a long time, the coin checkers alone have been removable from the vending machine. But this does not improve the serviceability of the control mechanism. Even if the coin analyzer and the control mechanism are removable from the vending machine as one assembly, this does not facilitate the work required to eliminate trouble at the vending machine location.

SUMMARY OF THE INVENTION

It is an object of this invention to propose a vending machine of the type described at the outset, in which the control mechanism in the vending machine can be moved into a position for servicing in which it is accessible and in which it is uncoupled from the merchandise dispensing devices.

According to the invention, this problem is solved in that the coin analyzer and the control mechanism are mounted on a bracket which is movable on horizontal tracks of the vending machine from a pushed-in operating position, into a pulled-out exposed position, the bracket is hinged so as to be pivotable in the pulled-out position about a vertical axis, and there is provided, at the bracket, a coupling device which couples the control mechanism in the pushed-in position to the locking bar and to the slide lock and which disengages when the bracket is moved into the pulled-out position.

Due to the measures described, the bracket with the coin analyzer and the control mechanism can be pulled out toward the front of a machine after opening the vending machine door, and can then be flipped to the side away from the door. On the one hand, the coin analyzer and the control mechanism are then accessible from the front. On the other hand, devices in the in the machine which were hidden in the pushed-in position of the bracket, are also made accessible. The control mechanism is uncoupled from the locking bar and the slide lock when the bracket is pulled out. The required coupling is reestablished merely be pushing the bracket back into the machine.

The coupling device must be designed so as to lead to the proper release of the slide lock on the one hand and, after the release of the locking bar by the slide lock, transmit the locking bar motion to the control mechanism and the coin analyzer, on the other.

In the vending machine, a change making device of great capacity, for coins to be returned, can be disposed in the space behind the coin analyzer. Such change making devices multiply the possible sales prices in vending machines. They also provide the possibility of issuing deposit tokens together with the merchandise.

To make the change making device easily refillable, it should be mounted and designed so that it can be pulled out against biasing forces which are as weak as possible and that it is automatically coupled to its control mechanism when pushed back in. In addition, smooth and easy operation should be assured.

For this purpose, the coin store is fastened, in a further development of the invention, to another bracket which can be pulled out along the vending machine track parallel to the merchandise dispensing compartment. A release lever takes along a control lever in the bracket pull-out direction, for which an idle stroke is provided in the closed position of the merchandise dispensing compartment between its top and the coupling member. A return member is attached to the bracket to cause the control lever to follow the release lever when the bracket is pushed back. The change making device can thus be pulled forward in the vending machine to refill its coin store(s). No manipulation on the part of the refiller is required to uncouple the release lever or the control lever. When the bracket is pushed back in, the control lever automatically regains the position from which it can actuate the release lever. The control lever itself is not hindered by the stop of the merchandise dispensing compartment when the bracket is pulled out. No return springs are needed which either interfere with pulling out the bracket or have an adverse effect on the smooth and easy operation of the change maker.

In a preferred embodiment of the invention the return member is formed by a spring clip which, under no load when the bracket is pushed in, causes the control lever to contact the release lever. What this achieves is, on the one hand, that the control lever, and accordingly the coupling member, can be brought exactly into the starting position, but no strong spring forces are exerted on the control lever in the starting position. On the other hand, the spring clip permits an overtravel, favorable for the prevention of jamming, after an actuation of the release lever.

To improve smooth and easy operation, in a further development of the invention, when there are two separately addressable coin stores, the coupling members or stops associated with them are staggered relative to each other so that only one release lever is actuated first, and only thereafter is the other release lever actuated, whenever a merchandise dispensing compartment is actuated.

The invention is applicable to these vending machines where the merchandise dispensing devices are juxtaposed in the form of drawers or push buttons in a row as well as to those vending machines where several merchandise dispensing flaps are provided one on top of the other.

Accordingly, an object of the invention is to provide a mechanical vending machine with a coin analyzer and a control mechanism for the release of at least one merchandise dispensing mechanism after the insertion of an appropriate amount in coin, the control mechanism being coupled to a locking bar of the merchandise dispensing mechanism and having a slide lock for locking the locking bar, with an improvement comprising, a bracket on which is mounted the coin analyzer and the control mechanism, at least one horizontal track in the vending machine on which is slidably mounted the bracket so as to be movable from a pushed in position to a pulled out position, the bracket having a hinge by means of which the bracket can be pivoted, in its pulled out position, about a vertical axis, and coupling means connected to the bracket for coupling the control mechanism to the locking bar and slide lock with the bracket in its pushed in position, and for uncoupling the control mechanism from the locking bar and from the slide lock, in its pulled out position.

Another object of the invention is to provide such an improvement in mechanical vending machines which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
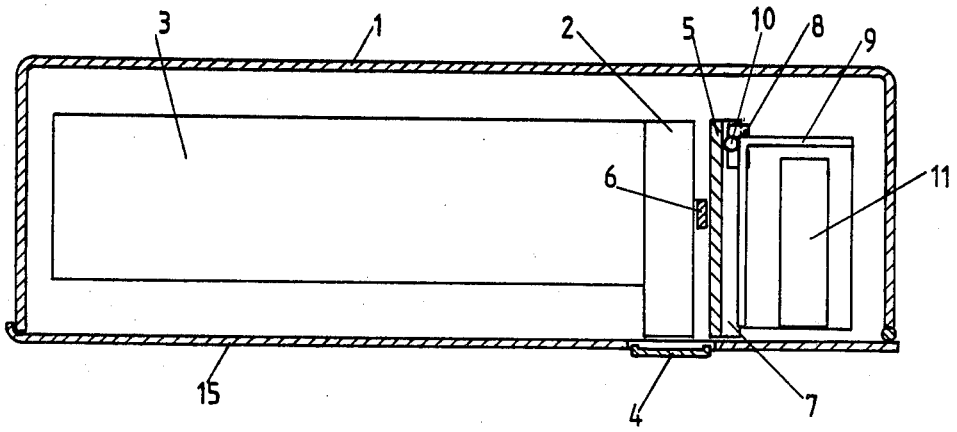
FIG. 1 is a simplified top plan view of an embodiment of the invention, partially in section, with a vending machine having a closed door.
Figure 2:
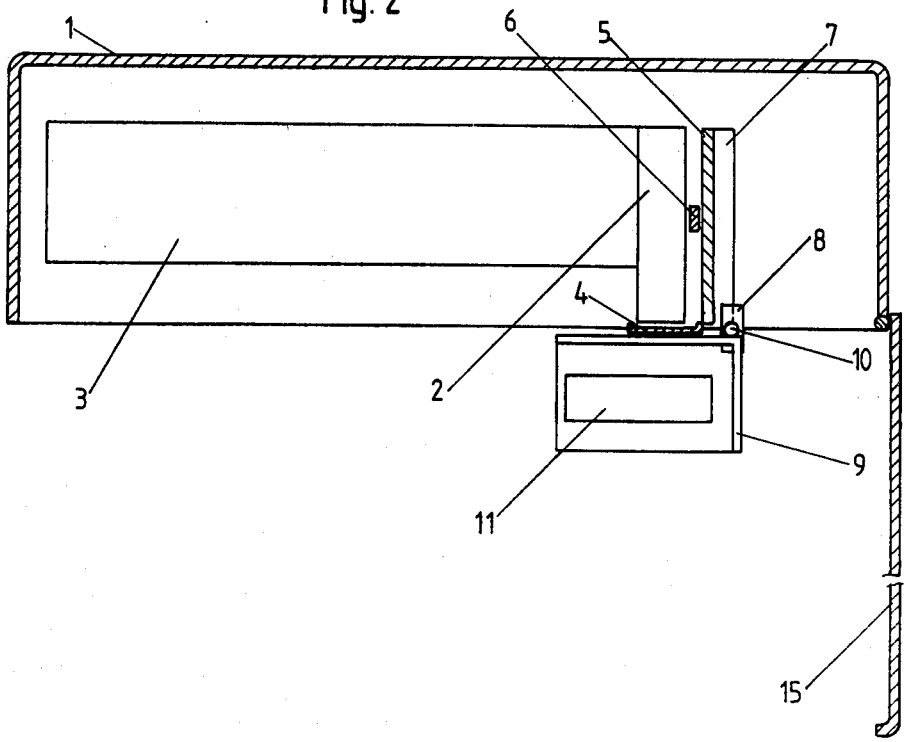
FIG. 2 is a view similar to FIG. 1 with the vending machine door open and a bracket, carrying a coin analyzer and control mechanism, in its pulled out or exposed position.

In the vending machine depicted in FIGS. 1 and 2 several merchandise dispensing boxes 2 are arranged one on top of the other in a vending machine housing 1. An inclined sheet metal seat 3 for bottles or cans, ends in each one of the boxes 2. Each mechandise dispensing box 2 is closed in front by a flap 4. In accordance with the superposed arrangement of the boxes 2 or flaps 4, an operating base plate 5 stands upright in the vending machine housing. A locking bar 6 and sliders, not detailed, for the mutual locking of the flaps 4, are connected to the operating base plate 5, as is usual. Refer to the PRICE SETTING MECHANISM FOR A VENDING MACHINE application, cited above. Bar 6 thus can lock or release a dispensing mechanism, whether it is the flaps 4 or some other actuation for dispensing an item from the machine.

Figure 3:
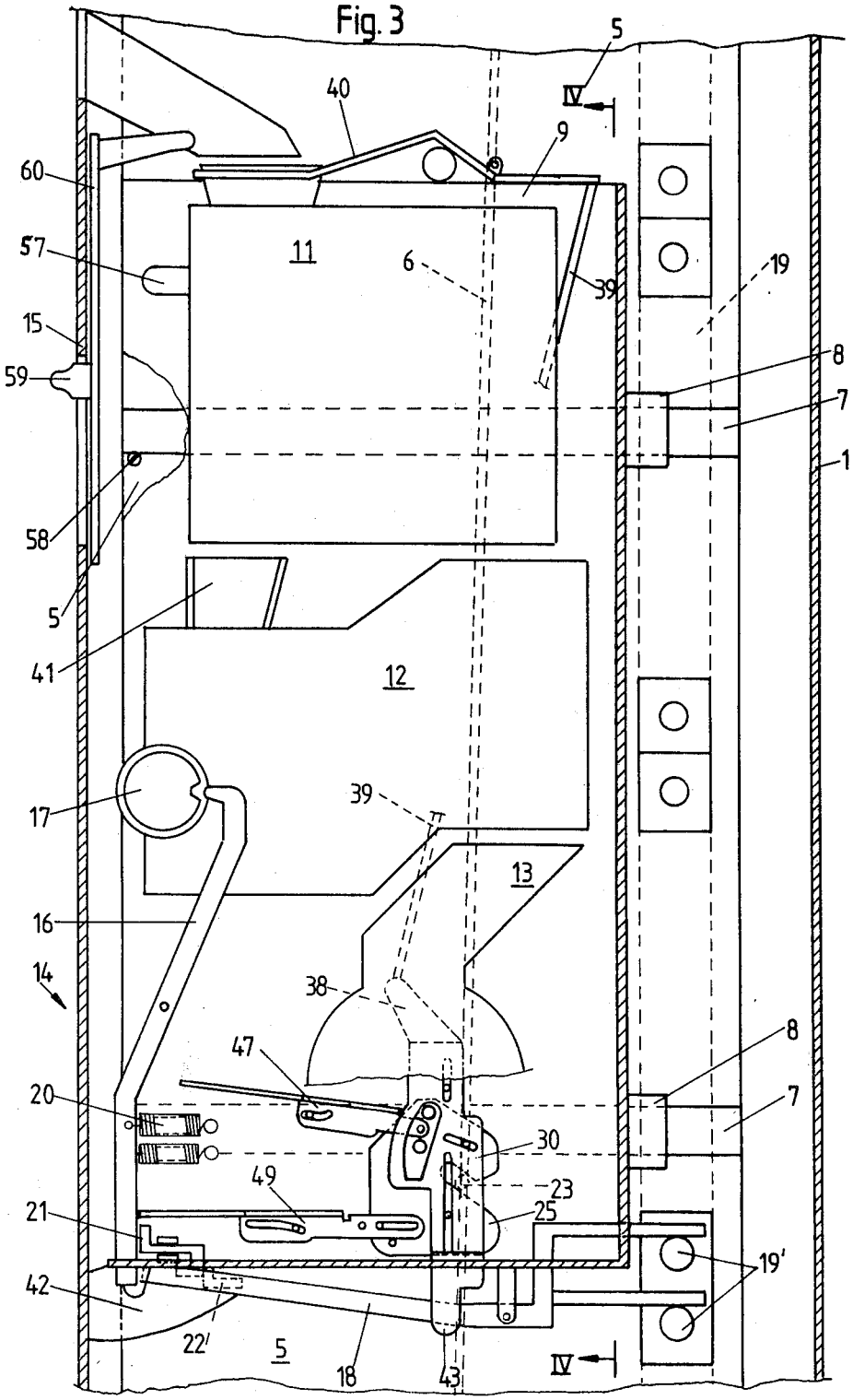
FIG. 3 is a right side elevational view, partially in section, of the coin analyzer and control mechanism shown in FIGS. 1 and 2, on an enlarged scale.
Figure 4:
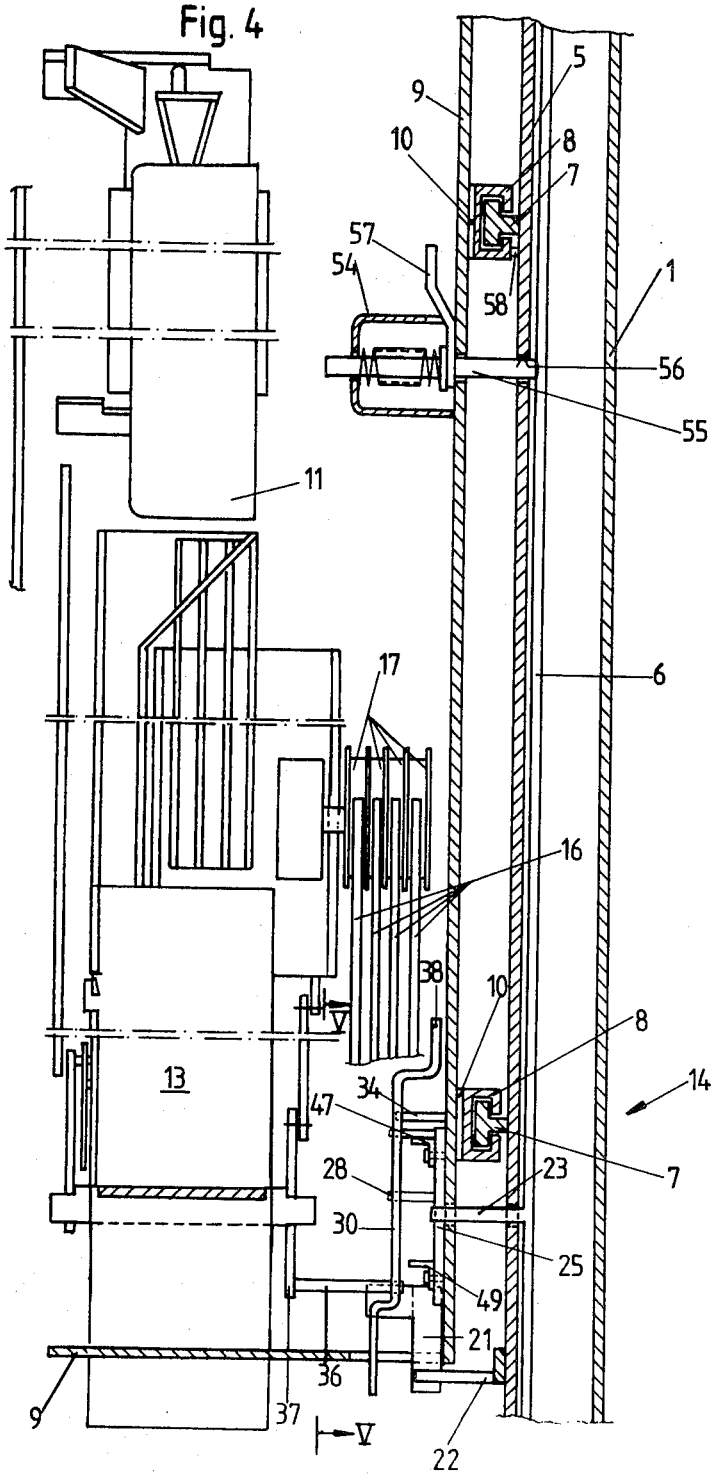
FIG. 4 is a rear elevational view, partially in section, and taken along the line IV—IV of FIG. 3.
Figure 5:
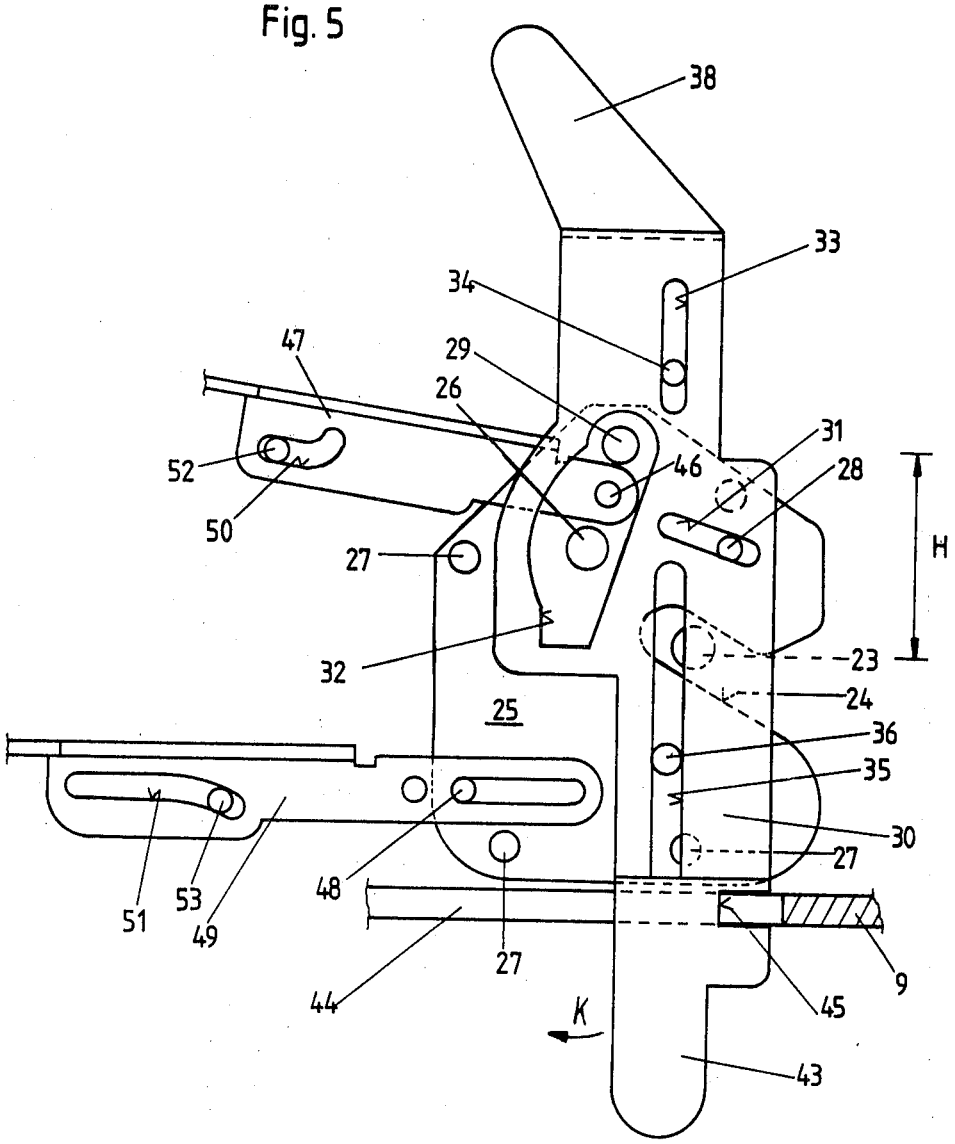
FIG. 5 is an enlarged view of part of the control mechanism taken along the line V—V of FIG. 4.

Tracks 7, running horizontally, are disposed on the operating base plate 5 at its side facing away from the boxes 2. A bracket 9 is mounted on the tracks 7 by means of profiled sections 8. Hinges 10 with a vertical pivot axis are provided between the profiled sections 8 and the bracket 9 (see FIGS. 3 to 5).

A coin analyzer, consisting of a coin checker 11, a crediting unit 12 and a collector 13 is disposed on the bracket 9. In addition, a control mechanism 14 is disposed on the bracket 9.

FIG. 1 shows the bracket 9 in its pushed in or operating position in which the door 15 of the vending machine housing is closed. In FIG. 2, the door 15 is open and the bracket 9, sliding on the tracks 7, is pulled out and pivoted about the hinge 10 into its exposed position. In this pulled out or exposed position of bracket 9, the devices disposed on the bracket 9 can be inspected. Also, the space behind the bracket 9 in its pushed in or operating position is now accessible.

In the example shown, the control mechanism 14 is designed as a multiple price control. It has four scanning levers 16 which interact with cam plates 17 which is stepped or incrimentally rotated by the crediting unit 12. Associated with the scanning levers 16 are locking levers 18 controlled by price control rods 19. One end of each locking lever 18 rests against a pin 19' fastened to each price control rod 19. The price control rods 19 are coupled to the merchandise dispensing devices 2 in accordance with the intended sales price. As soon as one of the scanning levers 16 engages a cam so that the associated locking lever 18 releases the scanning lever 16, the scanning lever 16 shifts a slide lock 21 likewise mounted to the bracket 9, due to the action of an extension spring 20. In this process, the slide lock 21 shifts an angle 22 mounted to the operating base plate 5 and after this motion, release the locking bar 6. The configuration of the slide lock 21 in relation to the angle 22 is such that when the bracket 9 is pulled forwardly, out of its operating position, the slide lock 21 with the bracket 9 leaves the angle 22, and strikes it when the bracket 9 is pushed inwardly, into its operating position.

A bolt 23 is fastened to the locking bar 6. In the pushed in position of the bracket 9, this bolt engages a recess 24 is a rotating plate 25 mounted to a pivot pin 26 on the bracket 9. The rotating plate 25 has bumps 27 by means of which it is in contact with the bracket 9. The recess 24 is designed so that the rotating plate 25 leaves the bolt 23 when the bracket 9 is pulled forwardly and so that the bolt 23 engages the recess 24 when the bracket 9 is pushed in. In normal or operating position (see FIG. 5), the recess 24 runs obliquely at an angle of approximately 30° relative to the pull out direction of the bracket 9. In the pivoted end position, the recess 24 runs correspondingly oblique at about 60° relative to the normal operating position, so that the recess 24 can disengage from the bolt 23 in the end positions, and therefore, also in all intermediate positions, when the bracket 9 is pulled out, or forwardly from the housing.

Two bearing pins 28 and 29 are disposed on the rotating plate 25 which serve to drive a control lever 30 and which engage guide slots 31 and 32. In addition, the control lever 30 is mounted by means of an elongated hole 33 to a pin 34 fixed to the bracket 9. The control lever 30 has another elongated hole 35 engaged by a pin 36 which causes the collector 13 to assume the collecting position by means of an eccentric 37 (see FIG. 4).

A control cam 38 is formed on the control lever 30 which interacts with a slide 39 capable of opening the coin checker 11 in such a manner and via a control lever 40 (FIG. 3), that coins reach a coin return box 42 directly through a coin return chute 41.

The control lever 30 is further provided with a guide cam 43. Cam 43 slides in a slot 44 of the bracket 9. The guide cam 43 has a cutout 45 which enables the control lever 30 to grip around the rim of the slot 44.

An upper control arm 47 engages a bolt 46 of plate 25 and a lower control arm 49 a bolt 48 of plate 25. The control arms 47 and 49 are mounted to pins 52, 53 fixed to the bracket 9, which pins penetrate curved guide slots 50 and 51, respectively. The purpose of the control arms 47 and 49 is to lift the scanning levers 16 off the cam plates 17 when the rotating plate 25 pivots. The guide slots 50 and 51 are curved so that the points of contact of the control arms 47 and 49 with the scanning levers 16 change little to avoid friction.

Mounted to the bracket 9 is a yoke 54 in which a spring-loaded locking pin 55 is guided. The operating base plate 5 has a hole 56 in which the locking pin 55 is retained in the pushed in position of the bracket 9. A handle 57 is provided to lift the locking pin 55 out of the hole 56. This provides assurance that the bracket is fixed in its pushed in position, thus guaranteeing the correct relative positions of the devices.

The operation of the described machine is approximately as follows:

After the locking pin 55 has been pulled out of the hole 56 by actuating the handle 57 and the bracket 9 has been pulled forwardly (to the left in FIG. 3) and pivoted about its axis 10, the bolt 23 of the locking bar 6 is disengaged from the rotating plate 25. The slide lock 21 is no longer in contact with the angle 22. Also, the locking levers 18 are free of the pins 19' of the price control rods 19. Therefore, the functions of the various subassemblies can be examined singly so that possible malfunctions can be readily located. It is of particular advantage that the bracket 9 can be pulled forwardly in any position of the other subassemblies so that a disengagement is possible also should the mechanism be jammed due to a malfunction.

By pushing the bracket 9 back in, the required coupling of the devices supported by it and of the devices fixed to the machine is brought about automatically, the bolt 23 of the locking bar 6 engaging the recess 24 in the rotating plate 25, the locking levers 18 contacting the pins 19' of the price control rods 19, and the slide lock 21 striking the angle 22.

To limit the pulled-out position of bracket 9 on the tracks 7, a stop screw 59 is provided. By removing it, the bracket is including all components mounted to it, can be taken out of the vending machine.

When the bracket 9 has been pushed into the vending machine, the locking pin 55 is retained in the hole 56. In this pushed in position, the bolt 23 engages the recess 24. The control levers 18 are connected to the price control rods 19 via the pins 19', and the slide lock 21 rests against the angle 22. In this normal position (see FIG. 5), the lower control arm 49 keeps the scanning levers 16 away from the cam plates 17 so that they can advance as the coins are inserted without being stressed by the scanning levers 16. If it is then attempted to actuate one of the flaps 4, the locking levers 18 coordinated with their sales price, are pivoted. At the same time, the rotating plate 25 is turned so that, by the bolt 23 of the locking bar 6, the control arm 49 releases the scanning levers 16 so that the particular scanning lever located opposite the cam of the cam plate 17 assigned to it snaps into the cam, thereby shifting the slide lock 21 so that the locking bar 6 is also released by the angle 22, thus no longer preventing further opening of the respective flap 4 for the removal of merchandise. In the course of moving the locking bar 6 by means of one of the flaps 4 by the stroke H (FIG. 5), the rotating plate 25 turns by about 60° (counterclockwise). Due to this motion, the control lever 30 is raised immediately via the bearing pin 28 so that the control cam 38 prevents the collector 13 from accepting more coins. This is expedient because acceptance of more money during the scanning process between scanning levers 16 and cam plates 17 could lead to malfunctions.

As the rotating plate 25 continues to turn after the scanning process, the scanning levers 16 are lifted off the cam plates 17 by the upper control arm 47. The control lever 30 then pivots due to the cam surface 32 and the bearing pin 29, in the direction of arrow K so that the pin 36, engaging its elongated hole 35, is caused by the eccentric 37 to bring a bottom disposed in the collector 13 into collecting position, thereby causing the coins lying in the collector 13 and accounted for by the crediting unit 12 to drop into a cash box of the vending machine.

If a coin return button 59 is pushed, the pin 36 of the eccentric 37 will be pivoted counterclockwise by a coin return arm 60, over lever 40 and slide 39. This causes the cutout 45 to engage the rim of slot 44, thus blocking the control lever 30 and, hence, the rotating plate 25 also. Thus the actuation of the flaps 4 is prevented as long as the coin return button 59 is depressed.

The mechanism described also prevents the crediting unit 12 from accepting coins as long as the collector 13 is open to the coin return chute 41.

In the examples of the invention according to FIGS. 6–9, another bracket 106 is guided on the track 7 along with bracket 9. Standing upright on the bracket 106 are cylindrical coin stores 107 and 108, such as designed for the return of coins of two different denominations. Disposed in front of the bracket 106 are the coin analyzer and the control mechanism described in connection with FIGS. 1 to 5.

Each coin store 107, 108 has a release arm 110, 111 respectively, acted upon by an extension spring 112, 113, respectively. If the release arm 110 or 111 is pulled in the direction of arrow P (see FIG. 6), one of the coins in the respective coin store 107 or 108 assumes an intermediate position. Upon the release of the release arm 110 or 111, the arm is moved opposite to the direction of arrow P by the action of the extension spring 112 or 113, causing the coin to drop from its intermediate position into the coin return chute 41, 42.

For the actuation of the release arm 110 it is in contact with a control lever 114 with a rounded end 114*a*. The control lever 114 is connected to a control bar 116 extending over all merchandise dispensing compartments 2. At each merchandise dispensing compartment 2 a pivotable coupling member 117 is attached to the control bar 116. Analogously, a control lever 118 with end 118*a*, on another control bar 119 supporting pivotable coupling member 120 is coordinated with the release arm 111.

Fastened to the bracket 106 are two spring clips 121 and 122. The free end of spring clip 121 is in contact with the control lever 114. The free end of the spring clip 122 is in contact with the control lever 118. In the initial position shown in FIG. 6, the spring clips exert virtually no pressure on the control levers.

Mounted to each merchandise dispensing compartment 2 is a stop 123, with the lowered coupling members 117, 120, respectively, projecting into its path of motion. Raised coupling members are outside of the path of motion of the stop 123.

Figure 9:
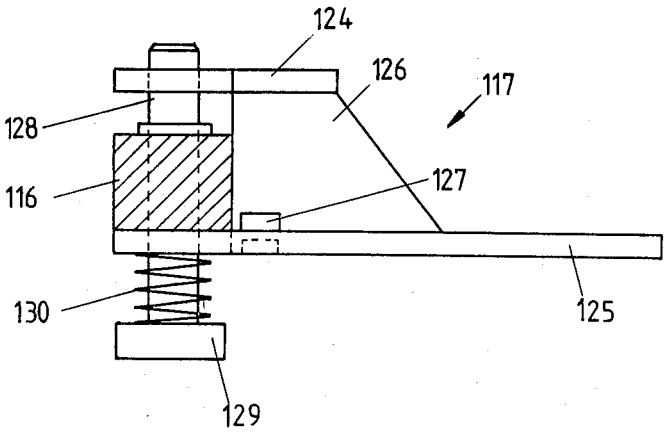
FIG. 9 is an enlarged top plan view of a coupling member which can be flipped, and which can be used in the embodiment shown in FIG. 6.

FIG. 9 shows a flippable coupling member 117 in lowered position. The coupling member 117 is U-shaped in profile with legs 124 and 125 and a web 126. A lug 127 is disposed on the inside of leg 125. The legs 124 and 125 are mounted to a bolt 128 pushed through the control bar 116 or 119 and having a head 129. A compression spring 130 is inserted between head 129 and leg 125. In the position shown in FIG. 9, the leg 125 is pushed against the control bar 116 by the compression spring 130. The web 126 contacts the control bar 116. To raise the coupling member 117 it is moved along the bolt 128 against the force of the compression spring 130 and turned upwardly by 90°. The lug 127 then rests next to the control bar 116 so that the coupling member 117 remains in this position.

Figure 8A:
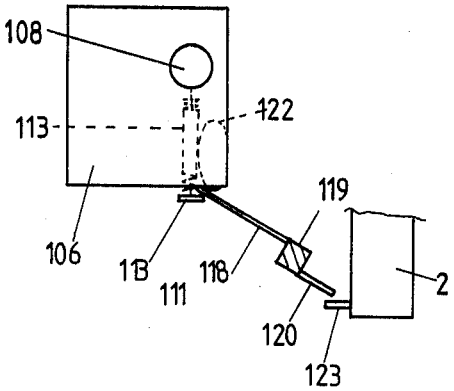
FIG. 8*a* to 8*c* are schematic top plan views illustrating the operation of the embodiment of FIG. 6, and showing three positions thereof.
Figure 8B:
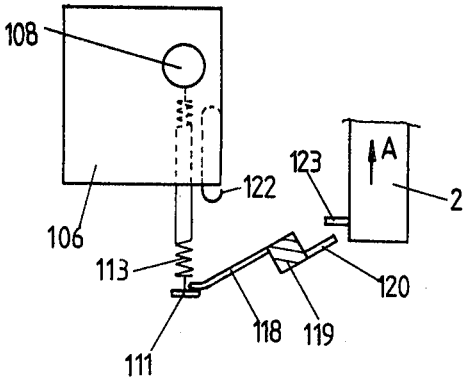

The operating mode of the described coin return mechanism will now be explained in greater detail with reference to FIGS. 8*a* to 8*c*, which show only one coin store 108. With two coin stores, the function is analogous.

Figure 6:
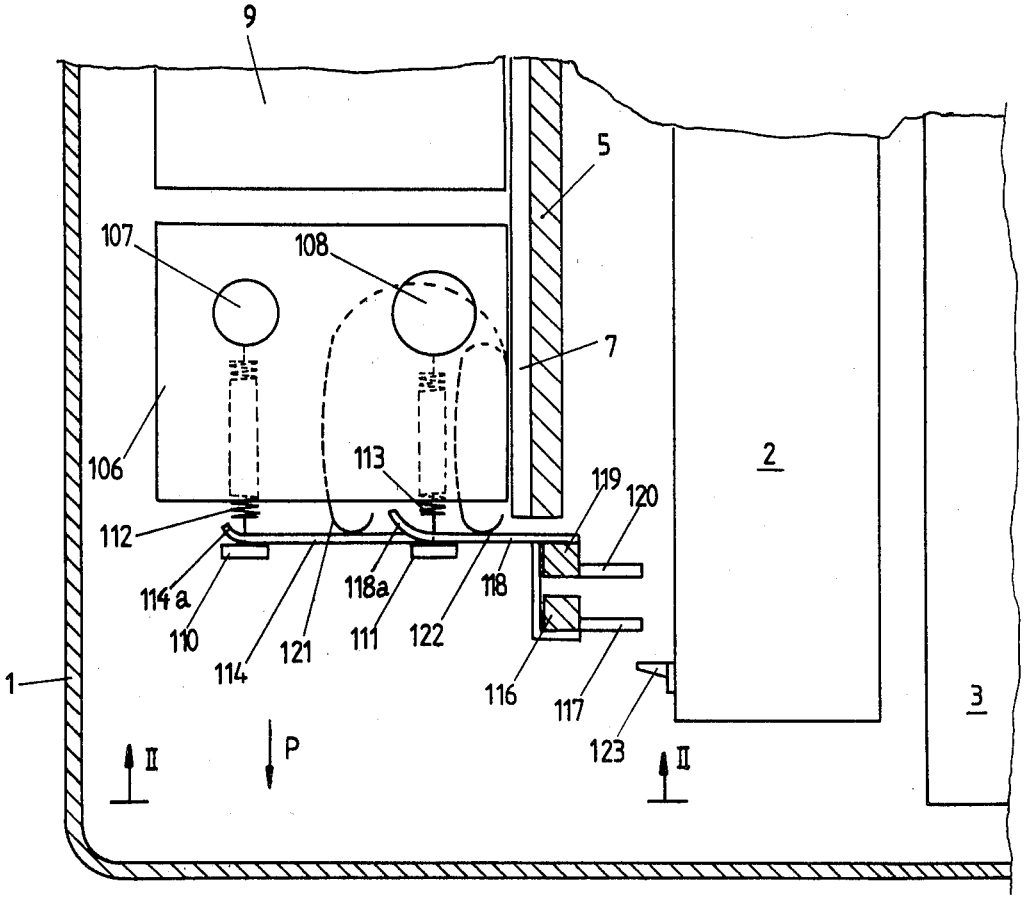
FIG. 6 is a top plan fragmentary view, partially in section, of a change making device in a vending machine according to the invention.
Figure 7:
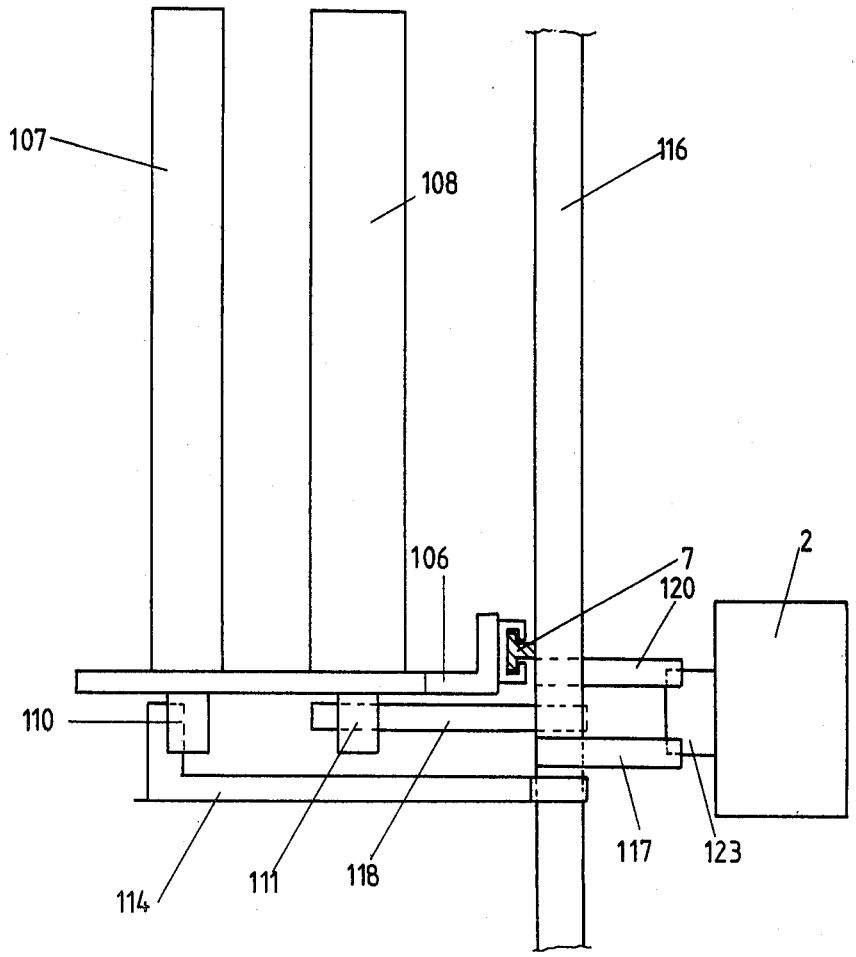
FIG. 7 is a rear elevational view taken along the line II—II of FIG. 6.

If, starting from the initial position shown in FIG. 6, the bracket 106 is pulled forward, the release arm 111 will take along the control lever 118 accordingly. The control bar 119 turns and the coupling members 120 pivot (see FIG. 8*a*). The coupling members 120 will not strike the stop 123 because in the pushed in position of the merchandise dispensing compartment 2 there is an idle stroke or an appropriate distance between both parts. When the bracket 106 is pulled forward, the coin store 108 will be located far in front in the vending machine so that it can be refilled easily. When the bracket 106 is subsequently pushed back in, the spring clip 122 will push the control lever 118 back into its starting position.

If one of the merchandise dispensing compartments 2 is pulled in arrow direction A (see FIG. 8*b*) for the removal of merchandise, the stop 123 will strike the lowered coupling member 120, causing the control bar 119 to turn and the control lever 118 to pull the release arm 111 backwardsly. After a certain stroke the stop 123 will pass the coupling member 120 so that the extension spring 113 pulls the release arm 111 back, actuating the coin return. As the release arm 111 returns to its initial position, it takes along the control bar 119. Should this represent an undesired strain on the extension spring 113, a weak return spring can be disposed on the control bar 119.

If two coin stores 107 and 108 are provided and both coupling member 117 and 118 are lowered (see FIG. 7), the stop 123 will first actuate the one control lever 114 and then the other 118 so that the two extension springs 112 and 113 are not extended simultaneously, but successively. This prevents high peaks of force from occurring when operating the merchandise dispensing compartments manually.

Figure 8C:
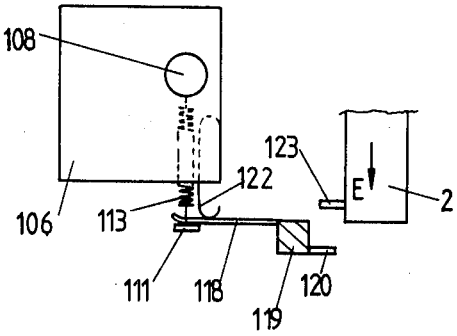

When the merchandise dispensing compartment 2 is pushed back in again, the stop 123 will act upon the coupling member 120 in arrow direction E (see FIG. 8*c*). The spring clip 122 makes certain that the stop 123 can pass the coupling member 120 without exerting undue force and without jamming.

While specific embodiments of the invention have been shown and described in detail to illustrate the application of the principles of the invention, it will be understood that the invention may be embodied otherwise without departing from such principles.

What is claimed is:

1. In a mechanical vending machine with a coin analyzer and a control mechanism for the release of at least one merchandise dispensing mechanism after the insertion of an appropriate amount in coin, the control mechanism being coupled to a locking bar of the merchandise dispensing mechanism and having a slide lock for locking the locking bar, the improvement comprising:

a bracket on which is mounted the coin analyzer and the control mechanism;

at least one horizontal track in the vending machine on which is slidably mounted said bracket so as to be movable from a pushed-in position to a pulled-out position;

said bracket having a hinge by means of which said bracket can be pivoted in its pulled-out position about a vertical axis; and coupling means connected to said bracket for coupling the control mechanism to the locking bar and to the slide lock with said bracket in said pushed-in position, and for uncoupling the control mechanism from the locking bar and from the slide lock in the pulled-out position.

2. In a mechanical vending machine according to claim 1, wherein said coupling means includes a rotating plate rotatably mounted to said bracket having a recess generally facing in a direction away from a direction of sliding of said bracket when said bracket moves from its pushed-in position to its pulled out position, the locking bar including a bolt extending therefrom and engaged in said recess with said bracket in its pushed in position and disengaged from said recess with said bracket in its pulled out position.

3. In a mechanical vending machine according to claim 2, wherein the coin analyzer includes a coin checker and a coin collector disposed under said coin checker for receiving a coin from said coin checker, said coupling means including a control lever movably mounted on said bracket and movable by rotation of said rotating plate when said rotating plate is rotated by movement of the locking bar with said bracket in its pushed-in position, said control cam operatively connected to said coin checker for activating said coin checker, and an elongated hole operatively connected with said coin collector for controlling said coin collector.

4. In a mechanical vending machine according to claim 2, including a plurality of scanning levers rotatably mounted to said bracket for moving the slide lock and a pair of control arms movably mounted to said rotating plate and engageable with at least one of said scanning levers to hold said one scanning lever with rotation of said rotating plate.

5. In a mechanical vending machine according to claim 2, wherein said recess in said rotating plate is inclined, in a non-rotated position of said rotating plate, at an angle with respect to the direction of movement of said bracket as it moves from its pushed-in position to its pulled-out position, said pivoting plate being pivotable by twice said angle by movement of the locking bar.

6. In a mechanical vending machine according to claim 1, including a pull-out merchandise dispensing compartment having a stop extending therefrom, at least one pivotably mounted control bar pivotable by said stop with movement of said compartment in a pull-out direction, a control lever extending from said control bar, the improvement including a further bracket slidably mounted on said at least track adjacent said first mentioned bracket, at least one coin store connected to said further bracket for storing a supply of coins, a spring loaded release arm operatively connected to said coin store for discharging one coin at a time from said coin store with activation of said release arm, said further bracket mounted for movement on said at least one track in said pulled-out direction of said compartment, said release arm engaged with said control lever to pivot said control bar with sliding movement of said further bracket along said track to withdraw said bracket at least partially from the vending machine, and a return member connected to said further bracket and engaged with said control lever for biasing said control lever to follow said release arm when said further bracket is moved back into the vending machine along said track.

7. In a vending machine according to claim 6, said return member comprising a spring clip engaged with said control lever for exerting substantially no load on said control lever with said further bracket slid fully into the vending machine and for holding said control lever against said release arm when said further bracket is withdrawn from the vending machine along said track.

8. In a vending machine according to claim 7, wherein said control bar includes a coupling member extending therefrom into the path of said compartment stop, said stop passing said coupling member upon pull-out movement of said compartment so that said control lever is returned to a starting position by means of said release arm.

9. In a vending machine according to claim 8, including flip means connected between said coupling member and said control bar for adjusting a position of said coupling member to be selectively in the path of movement of said stop or out of the path of movement of said stop.

10. In a vending machine according to claim 6, including at least two coin stores mounted on said bracket, the vending machine including at least two control bars each associated with one store coin, a coupling member for each control bar positioned to engage said stop, with relative movement of said further bracket and said compartment, at different times during said relative movement.

* * * * *